US010641590B2

(12) United States Patent
Buttolph

(10) Patent No.: US 10,641,590 B2
(45) Date of Patent: May 5, 2020

(54) WING DEPLOYMENT AND LOCK MECHANISM

(71) Applicant: Simmonds Precision Products, Inc., Vergennes, VT (US)

(72) Inventor: Martin Edwy Buttolph, Leicester, VT (US)

(73) Assignee: Simmonds Precision Products, Inc., Vergennes, VT (US)

( * ) Notice: Subject to any disclaimer, the term of this patent is extended or adjusted under 35 U.S.C. 154(b) by 470 days.

(21) Appl. No.: 15/335,151

(22) Filed: Oct. 26, 2016

(65) Prior Publication Data

US 2018/0112959 A1 Apr. 26, 2018

(51) Int. Cl.
*F42B 10/18* (2006.01)

(52) U.S. Cl.
CPC ..... *F42B 10/18* (2013.01)

(58) Field of Classification Search
CPC ..... F42B 10/14; F42B 10/18; F42B 10/20; B64C 3/546; B64C 3/56; B64C 5/12; B64C 2201/102
See application file for complete search history.

(56) References Cited

U.S. PATENT DOCUMENTS 2,601,962 A 7/1952 Douglas
2,937,828 A 5/1960 Clark et al.
3,196,793 A * 7/1965 Milenkovic ..... F42B 10/20 244/3.28
3,944,168 A * 3/1976 Bizien ..... F42B 10/20 244/3.28
3,946,969 A * 3/1976 Marburger ..... F42B 10/14 244/3.28
3,986,685 A * 10/1976 Marburger ..... F42B 10/14 244/3.28
3,998,407 A * 12/1976 Marburger ..... F42B 10/14 244/3.28
4,106,727 A * 8/1978 Ortell ..... B64C 39/024 244/218
4,175,720 A * 11/1979 Craig ..... F42B 10/14 244/3.28
5,082,203 A * 1/1992 Baubry ..... F42B 10/20 244/3.28
5,192,037 A 3/1993 Moorefield
5,671,899 A * 9/1997 Nicholas ..... B64C 3/40 244/3.28
6,186,443 B1 2/2001 Shaffer
6,695,252 B1 2/2004 Dryer
6,880,780 B1 4/2005 Perry et al.
7,185,847 B1 3/2007 Bouchard et al.
8,324,544 B2 * 12/2012 Palani ..... F42B 10/14 244/3.24

(Continued)

*Primary Examiner* — Joseph W Sanderson
(74) *Attorney, Agent, or Firm* — Kinney & Lange, P.A.

(57) ABSTRACT

A lock block for use in a flight vehicle to deploy and lock wings in a deployed position with the lock block having a forward end and an aft end and including a support member, a resilient member adjacent the aft end of the lock block, a first deploy pin extending from the resilient member, a second deploy pin extending from the resilient member, and a wedge located on a bottom side of the resilient member. The first deploy pin and the second deploy pin are each configured to engage a groove in a wing of the flight vehicle to push each wing into a deployed position.

20 Claims, 5 Drawing Sheets

(56) References Cited

U.S. PATENT DOCUMENTS

| | | | | |
|---|---|---|---|---|
| 8,338,769 | B1 * | 12/2012 | Sankovic | F42B 10/20 244/3.27 |
| 8,415,598 | B1 | 4/2013 | Terhune et al. | |
| 8,563,911 | B2 * | 10/2013 | Cohe | F42B 10/18 244/3.24 |
| 8,592,737 | B2 | 11/2013 | Deschatre | |
| 9,470,491 | B1 * | 10/2016 | Ginetto | F42B 10/14 |
| 9,702,673 | B1 * | 7/2017 | Ginetto | F42B 10/14 |
| 10,308,347 | B2 * | 6/2019 | Buttolph | B64C 3/56 |
| 2006/0270307 | A1 * | 11/2006 | Montalvo | A63H 27/008 446/64 |
| 2010/0308153 | A1 * | 12/2010 | Cohe | F42B 10/18 244/3.27 |
| 2015/0353186 | A1 | 12/2015 | Buttolph | |
| 2018/0111675 | A1 * | 4/2018 | Buttolph | B64C 3/56 |

* cited by examiner

WING DEPLOYMENT AND LOCK MECHANISM

BACKGROUND

Small flight vehicles, such as glide bombs and precision guided munitions, benefit from the use of deployable wings to help control the flight vehicle after the flight vehicle has been launched while being contained within the body of the flight vehicle during launch. The wings and the mechanisms that deploy the wings need to be light weight to increase the efficiency of the flight vehicle, inexpensive because the flight vehicle will likely be destroyed at the end of the flight, and reliable to ensure deployment of the wings occurs and the flight vehicle is able to carry out the flight with accuracy and dependability.

SUMMARY

A wing deployment and lock mechanism includes a first wing that is configured to pivot about a first pivot pin at an inner end of the first wing with the first wing having a first groove in the inner end of the first wing, a second wing that is configured to pivot about a second pivot pin at an inner end of the second wing with the second wing having a second groove in the inner end of the second groove, and a lock block that is adjacent to the inner end of the first wing and the inner end of the second wing. The lock block having a forward end and an aft end and includes a resilient member adjacent an aft end, a first deploy pin configured to be positioned within the first groove in the first wing when the first wing is in a stowed position and be positioned forward of the first groove of the first wing when the first wing is in a deployed position, a second deploy pin at the forward end with the second deploy pin being configured to be positioned within the second groove in the second wing when the second wing is in a stowed position and be positioned forward of the second groove of the second wing when the second wing is in the deployed position, and a wedge between the forward end and the aft end with the wedge configured to be aft of the first wing and the second wing when in the stowed position and to contact and lock the inner end of the first wing and the inner end of the second wing in place when in the deployed position.

A method for deploying two wings includes pushing a lock block in a forward direction through the use of a resilient member at an aft end of the lock block with the lock block including two deploy pins and a wedge positioned between the forward end and the aft end, moving the lock block from a stowed position where each of the two deploy pins are within grooves in the two wings to a deployed position where each of the two deploy pins are forward of the two wings, are no longer within the grooves, and have forced the two wings to have pivoted from the stowed position, through a deploy angle, and to the deployed position such that the two wings are adjacent stop surfaces. The method further includes positioning the wedge between inner ends of the two wings so that the two wings are locked in place and cannot pivot away from the stop surfaces and out of the deployed position.

A lock block having an aft end and a forward end includes a support member, a resilient member at the aft end of the lock block, a first deploy pin extending from the support member, a second deploy pin extending from the support member, and a wedge located on a bottom side of the support member.

DETAILED DESCRIPTION

Figure 1:
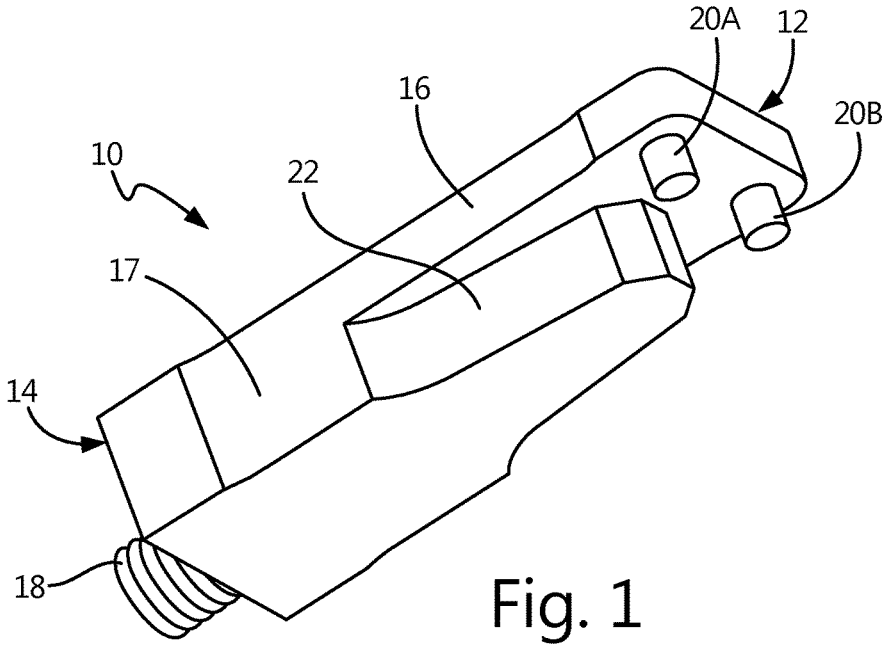
FIG. 1 is a perspective view of a lock block.

A wing deployment and lock mechanism for a guided flight vehicle is described herein that includes a lock block with deploy pins that move within grooves on the inner ends of two deployable wings. When the lock block moves from an aft position to a forward position, the deploy pins move forward within the grooves in the wings to pivot the two wings from a stowed position to a deployed position. When the wings reach a position near the deployed position, the deploy pins lose engagement with the grooves and continue forward out of the grooves such that the deploy pins are forward of the grooves and a wedge on the lock block becomes positioned between the inner ends of the wings. The wings, no longer constrained by the deploy pins, continue the last few degrees of rotation into the deployed position, where the wings make contact with their respective deploy stop surfaces. To increase redundancy and ensure the wings deploy completely into the deployed position, the wedge on the lock block will contact the inner end of each wing and the resulting contact will generate a moment to push the wings into and lock the wings in the deployed position. With the wedge in place between the inner ends of the wings, the wings are not allowed to pivot out of the deployed position (i.e., away from the stop surfaces) and are locked in place due to the shape of the inner ends of the wings. The wedge of the lock block is substantially triangular with a shallow angle to prevent rearward movement of the lock block (i.e., the lock block is self-locking). The wedge of the lock block and the inner ends of the wings are designed such that the wedge contacts the inner ends of the wings at a point forward of the wings respective pivot points (with the pivot point for each wing being at a pivot pin), creating a contact force line of action that passes in front of the pivot pins and results in moments about each pivot pin that holds the wing in the deployed position. In the deployed position, the lock block holds the wings against wing stops, which are located on an aft side of the wings.

To facilitate smooth and controlled motion and to deploy the wings simultaneously, the lock block can have a slot, which is a groove or another feature, that engages a mating feature on a housing of the flight vehicle. The slot can also be configured to keep the lock block centered along a centerline of the flight vehicle while still allowing the lock block to move between an aft position and a forward position. The slot in the lock block may have a varying width to more closely fit the mating feature on the housing when the lock block is near the aft position and permit some side-to-side movement of the lock block near the forward position to permit the lock block to center itself between the inner ends of the wings. Allowing the lock block to center itself between the inner ends of the wings ensures that the lock block is in contact with each of the inner ends of the wings and that contact is equalized to securely lock both wings in the deployed position. Furthermore, the self-centering configuration of the lock block provides for an increased manufacturing variation of the inner ends of the wings and the lock block while ensuring that the deployable wings will still be pushed into the fully deployed position and the contact force line of action is forward of the pivot pins to lock the wings in the deployed position.

This invention provides for a simple method to accurately hold both wings, particularly controlling the angle of incidence of the wings in the deployed position. The wings are pivoted and supported by the pivot pin, which can be a simple pin, and by flat surfaces in the housing above and below the wings. The pivot pin, which creates a pin joint, is very simple to achieve accurate fits. The pivot pin can be supported above and below the wing in a clevis-type arrangement, or the pin can be cantilevered from above or below the wing, allowing for easier assembly and disassembly of the flight vehicle. The inner ends of the deployable wings are supported and prevented from twisting within the flight vehicle when in the deployed position by flat surfaces within the housing that are adjacent to the inner ends of the wing. To provide a proper fit between the flat surfaces of the housing and the inner ends of the wings, the inner ends of the wings also have flats surfaces. A thickness of each of the inner ends of the wings can be slightly thicker than a thickness of the rest of the wing such that only the inner end of the wing is in contact with the flat surfaces of the housing, resulting in a small clearance between the inner end of the wing and the housing, allowing the wings to pivot and deploy while also preventing the wings from twisting within the housing when in the deployed position. Because the inner ends of the wings include only flat surfaces with respective holes through which the pivot pins extend, the interface between the housing of the flight vehicle and the wings is simple and inexpensive to manufacture.

The use of the lock block to deploy and lock the wings in place has many benefits. The mechanism is simple and includes very few components, with the lock block having deploy pins, the wedge, and a resilient member configured to move the lock block from the aft position to the forward position, and the wings having grooves and angled inner ends that rotate about pivot pins. The mechanism is rugged and able to handle the extreme forces sustained by the flight vehicle during launch and flight because the components are close-fitted but also have sufficient room to move and vibrate without becoming separated from one another. Because the lock block and other components are simple and rugged, the wing deployment and lock mechanism is more reliable by being less prone to damage and malfunction. The mechanism is also inexpensive, as the materials used to construct the resilient member, lock block, and wings can be common, inexpensive materials, such as plastic, aluminum, a composite, or another material. Further, the shape of the resilient member, lock block, and wing pivot and locking features is simple such that molding and/or machining of these components is not burdensome. With the lock block interacting with both wings simultaneously, the wings are deployed at the same time, allowing more accurate control of the flight vehicle during and after deployment of the wings. The wing deployment and locking mechanism holds the wings securely in the deployed and locked position, and provides accurate and tight control of the angle of incidence of the wings so that the wings are properly placed in the deployed position and control of the flight vehicle is correct and predictable. The wing deployment and locking mechanism is compact, particularly minimizing encroachment of components towards the center of the flight vehicle, where the volume is used for carrying payload. These benefits and more will be realized after review of the description below.

Figure 3A:
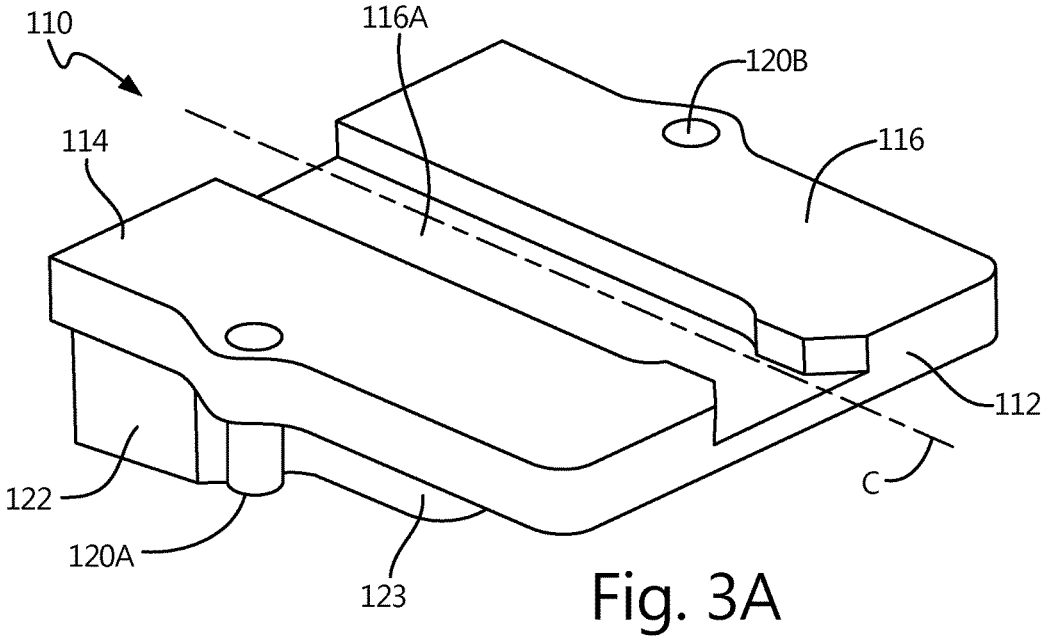
FIG. 3A is a perspective view of another embodiment of a lock block.
Figure 3B:
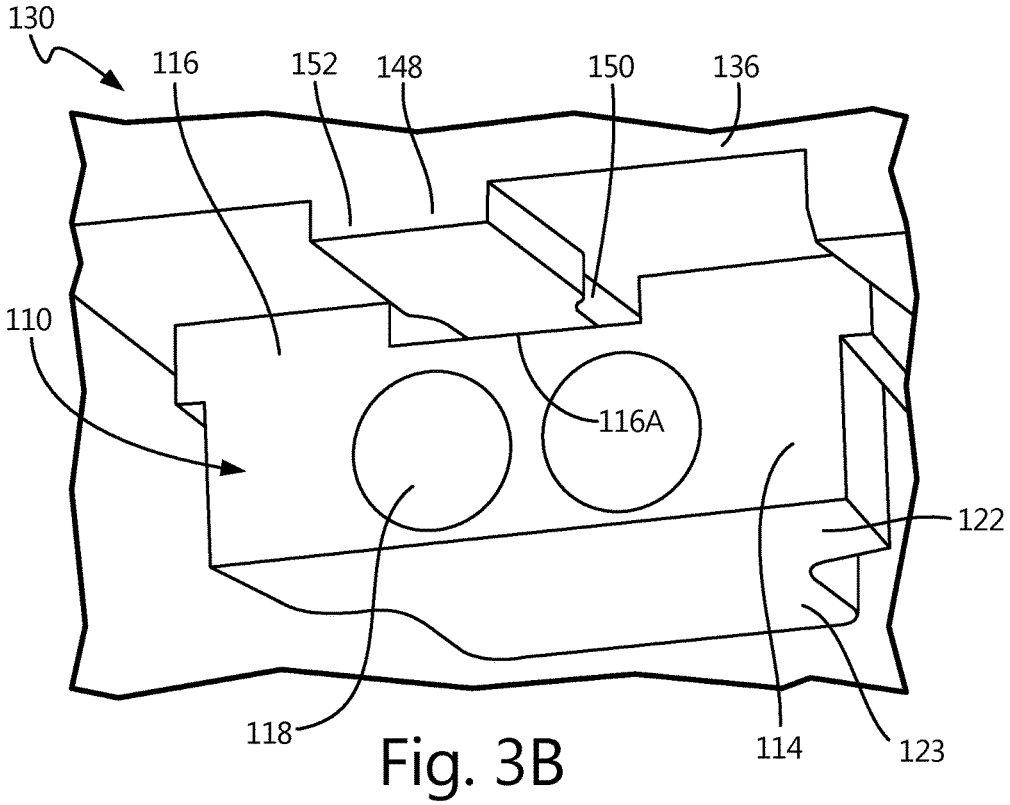
FIG. 3B is a partial cross-sectional perspective view of a flight vehicle with the lock block guided by a mating feature in the housing of the flight vehicle.
Figure 4:
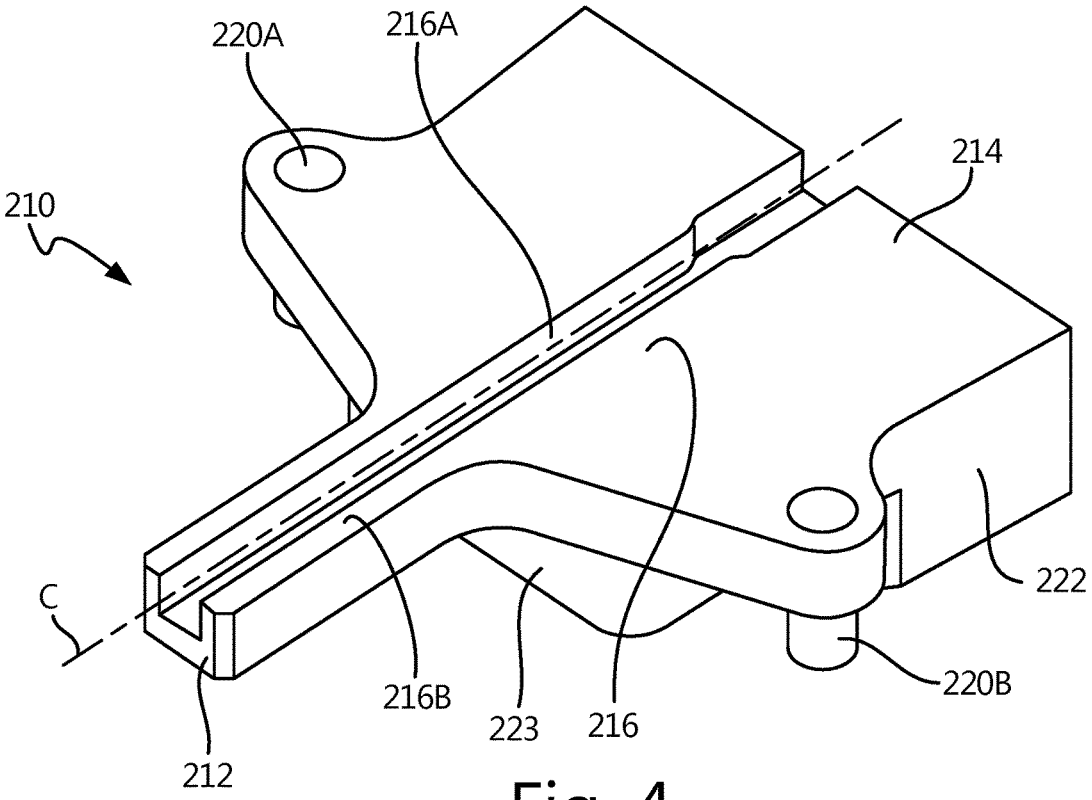
FIG. 4 is a perspective view of a third embodiment of a lock block.

FIG. 1 is a perspective view of a lock block. Lock block 10 has forward end 12, aft end 14, support member 16, body 17, resilient member 18, deploy pins 20 (with first deploy pin 20A and second deploy pin 20B), and wedge 22. Lock block 10 can be one continuous and monolithic piece formed during the manufacturing process, or lock block 10 can be individual components fastened or otherwise held together by various means. The components of lock block 10 can all be constructed from one material, such as aluminum, or each component can be constructed from a different material. Resilient member 18 can be constructed from rubber or another resilient material or can be one or multiple springs. Deploy pins 20 can be continuous and monolithic with support member 16, body 17, and wedge 22 so as to be constructed from the same material, or deploy pins 20 can be a different material, such as steel, that is pressed into holes in support member 16 or otherwise fastened to support member 16. Support member 16, body 17, and wedge 22 can be one continuous and monolithic piece that is molded or otherwise formed together from any material with sufficient strength and rigidity to hold up to the forces experienced by lock block 10, such as aluminum, or support member 16, body 17, and wedge 22 can be separate components that are constructed from the same or different materials and are fastened to one another after being constructed. Lock block 10 can include other features, such as a slot on a top side of support member 16 (as shown in FIGS. 3A, 3B, and 4) that interacts with a mating feature in a housing of the flight vehicle.

Support member 16 is a structural component of lock block 10 and extends on a top side towards forward end 12 to provide support for deploy pins 20. Support member 16 supports deploy pins 20 to transfer forces from resilient member 18, through deploy pins 20, and to the wings to deploy the wings. Support member 16 can have any shape, but support member 16 as shown in FIGS. 1, 2A, 2B, 2C, 2D, and 2E is substantially rectangular with a height that is less than the height of wedge 22. While support member 16 had filleted/curved ends at forward end 12, the ends can be any shape or configuration. Support member 16 can have holes near forward end 12 to accommodate deploy pins 20, or support member 16 can have other features to accommodate deploy pins 20.

Body 17 is a structural component on aft end 14 of lock block 10. Body 17 provides support to support member 16 and wedge 22. Body 17 can includes a hole or multiple holes in aft end 14 into which resilient member 18 can extend or be housed within, or body 17 can have other features to accommodate and provide attachment for resilient member 18. While the embodiment of lock block 10 in FIG. 1 includes body 17, body 17 may not be included in other embodiments as wedge 22 or other components of lock block 10 may be configured to accommodate resilient member 18 (as shown in the embodiments in FIGS. 3A-3B and 4).

Resilient member 18 is located at aft end 14 of lock block 10 and is adjacent to body 17 at one end and to a housing of the flight vehicle at another end. While shown as a single spring in FIG. 1, resilient member 18 can be multiple springs (as shown in FIGS. 2C, 2D, and 2E) or have another configuration that extends and pushes lock block 10 from the aft position to the forward position. Resilient member 18 can be a coiled spring, a rubber block, or another material. Further, resilient member 18 can be entirely outside body 17, can be partially or entirely contained within a hole in body 17 when resilient member 18 is compressed, and/or can be partially or entirely contained within a hole or multiple holes in the housing of the flight vehicle when resilient member 18 is compressed (as shown in FIG. 4B). It may be desired to contain resilient material 18 within body 17 (or another component of lock block 10) or the housing of the flight vehicle when space is limited around lock block 10. Resilient member 18 can be fastened to body 17 through various means, or resilient member 18 can be adjacent to and in contact with body 17 without otherwise being fastened to body 17. However, resilient member 18 should have sufficient expansive force to push lock block 10 forward to rotate the wings into the deployed position and provide continuous expansive force to ensure wedge 22 remains in place between the inner ends of the wings.

Deploy pins 20 (first deploy pin 20A and second deploy pin 20B) extend from a bottom side of support member 16 near forward end 12 of lock block 10. While deploy pins 20 are shown as cylindrical in shape in the disclosed embodiments, deploy pins 20 can be any size, shape, and length to fit and move within grooves in the wings to push the wings from the stowed position to the deployed position. Deploy pins 20 can be separate components that are pressed into holes in support member 16 or otherwise fastened to support member 16, or deploy pins 20 can be continuous and monolithic with support member 16 so as to be formed or otherwise manufactured simultaneously. Lock block 10 includes two deploy pins 20 (first deploy pin 20A and second deploy pin 20B), one for each of the wings. Deploy pins 20 can extend a length from the bottom side of support member 16 that is less than, equal to, or more than the height of wedge 22, depending on the depth, orientation, and configuration of the grooves in the wings in which deploy pins 20 move.

Wedge 22 is on a bottom side of support member 16 adjacent to body 17 and extends from body 17 towards forward end 12. Wedge 22 has a width that is greater near body 17 than a width near forward end 12. As shown in FIGS. 1, 2A, 2B, 2C, 2D, and 2E, wedge 22 can have a substantially triangular-shaped configuration with a width near body 17 that is equal to the width of support member 16 and body 17 and a width that begins to narrow as wedge 22 extends towards forward end 12. However, while wedge 22 has a substantially triangular-shaped configuration, the wider portion of wedge 22 near body 17 may not contact the inner ends of the wings as a width of an intermediate portion of wedge 22 may be sufficiently wide to contact the wings and hold the wings in place. The substantially triangular-shaped configuration of wedge 22 has several portions that angle/curve inward at different angles. Starting at a widest portion of wedge 22 near body 17, wedge 22 curves inward, then extends inward at a consistent angle for a majority of the substantially triangular-shaped configuration. Wedge 22 then angles inward at a greater angle before culminating at a point of wedge 22 closest to forward end 12 that is straight across lock block 10. Wedge 22 can have a variety of shapes and configurations, but wedge 22 should be shaped to interact with the inner ends of the wings to sit between the inner sides to prevent the wings from rotating out of the deployed position. In FIGS. 1, 2A, 2B, 2C, 2D, and 2E, wedge 22 has a height that is greater than the height of support member 16 and is equal to the height of body 17. The height of wedge 22 can be approximately equal to a height of the inner ends of the wings. The height of wedge 22 creates a large contact surface between wedge 22 and the inner ends of the wings. The interaction between lock block 10 and the other components of the flight vehicle will be described in greater detail with regards to FIGS. 2A, 2B, 2C, 2D, and 2E.

Figure 2A:
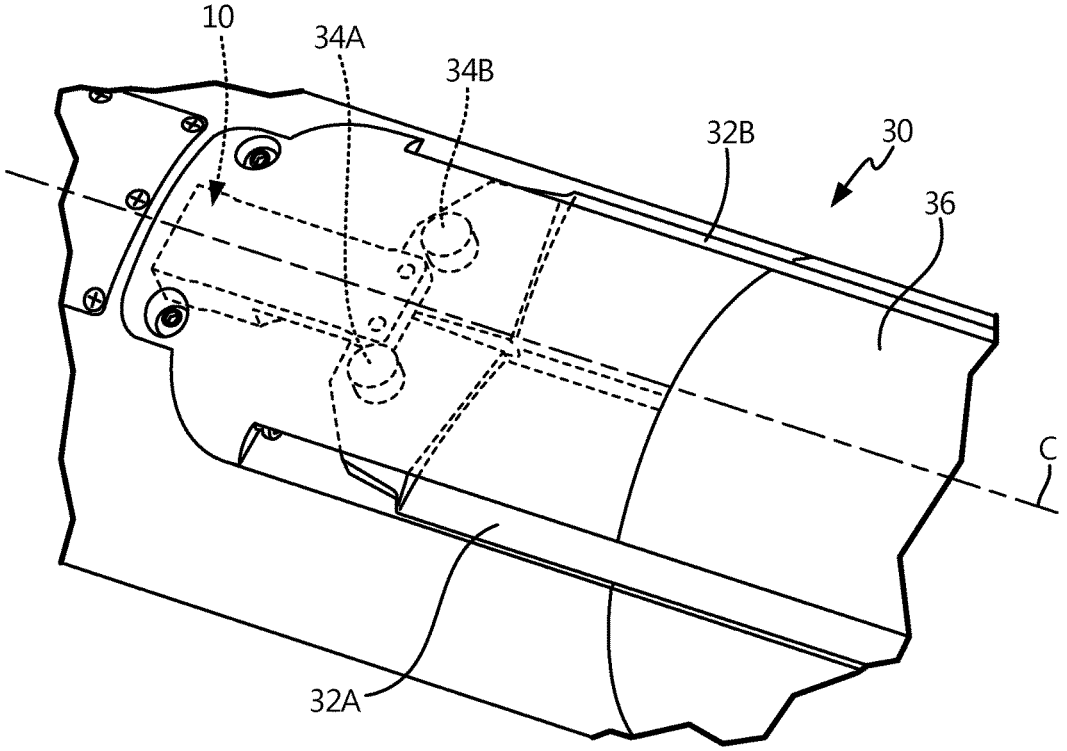
FIG. 2A is a partial perspective view of a flight vehicle with the lock block and wings in a stowed position.
Figure 2B:
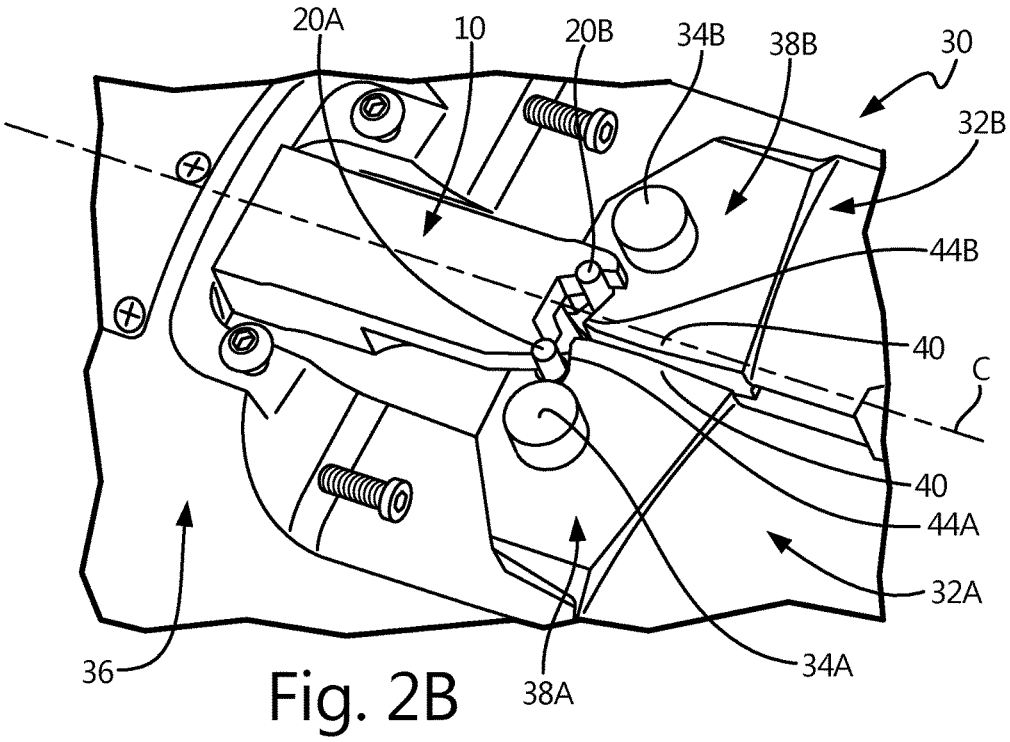
FIG. 2B is a partial perspective view of the flight vehicle with a portion of the lock block cut away.
Figure 2C:
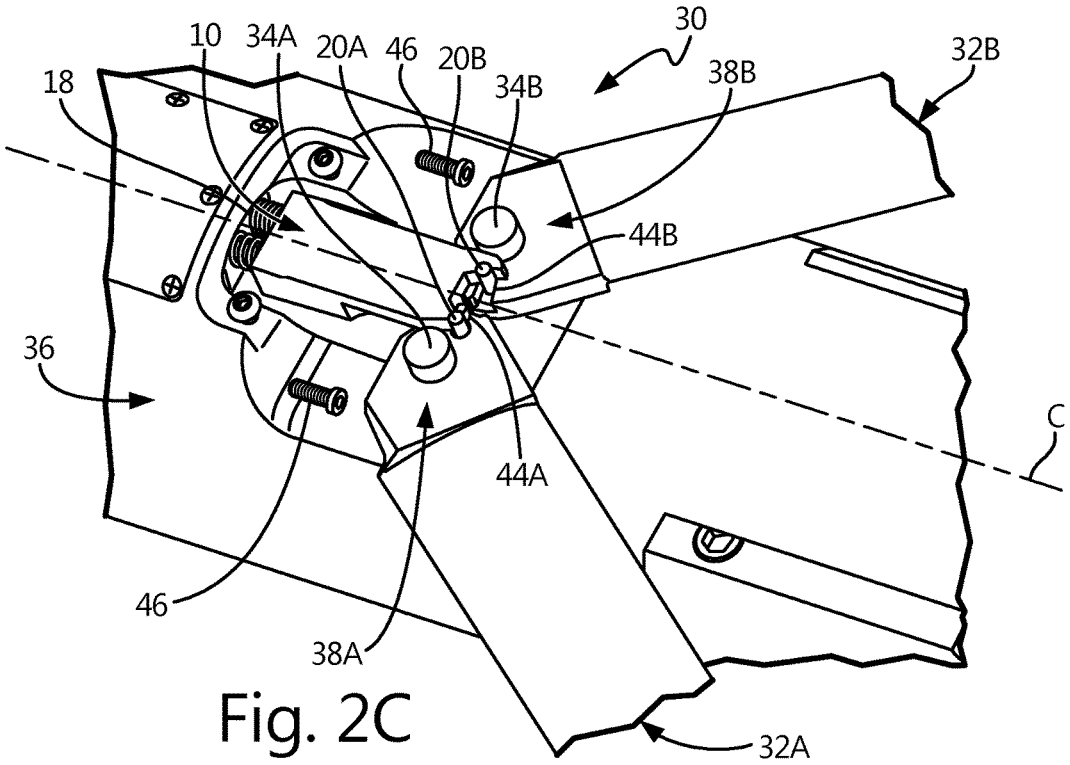
FIG. 2C is a partial perspective view of the flight vehicle with the lock block and wings between the stowed position and a deployed position.
Figure 2D:
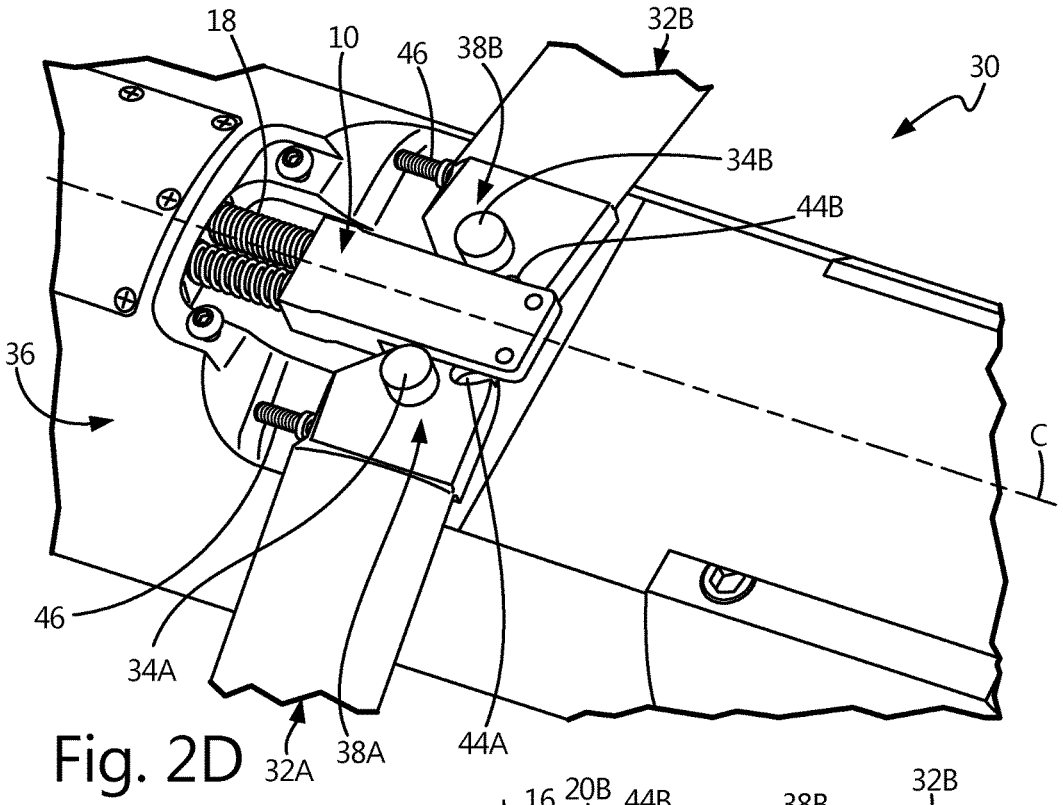
FIG. 2D is a partial perspective view of the flight vehicle with the lock block and wings in the deployed position.
Figure 2E:
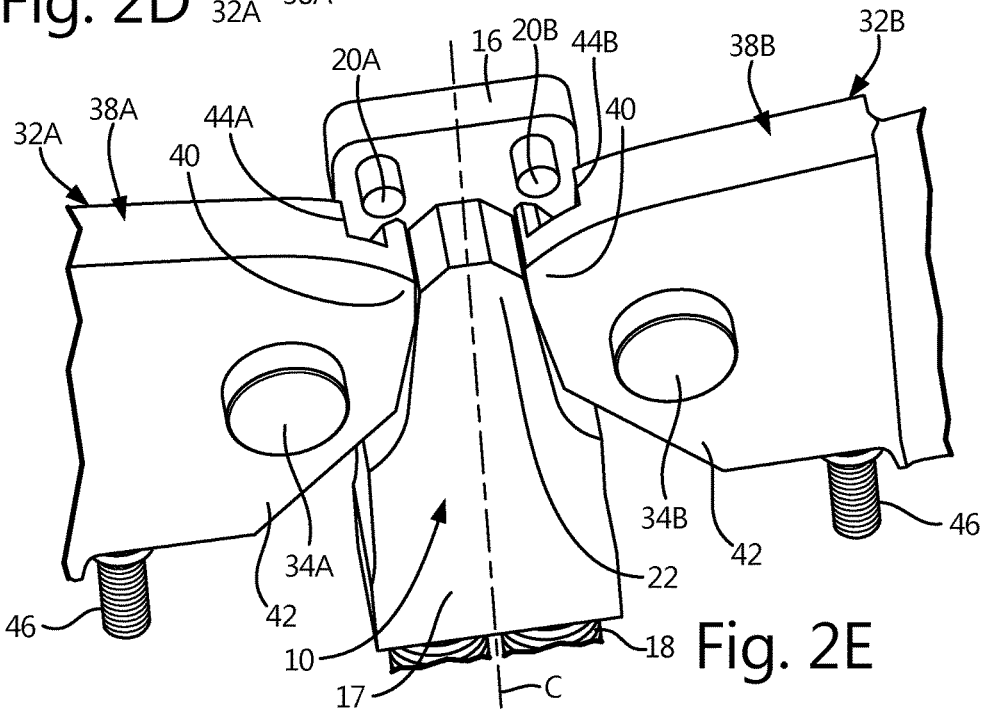
FIG. 2E is a partial perspective underside view of the lock block and wings in the deployed position.

FIG. 2A is a partial perspective view of the flight vehicle with the lock block and wings in a stowed position, FIG. 2B is a partial perspective view of the flight vehicle in FIG. 2A with a portion of the lock block cut away, FIG. 2C is a partial perspective view of the flight vehicle in FIG. 2A with the lock block and wings between the stowed position and a deployed position, FIG. 2D is a partial perspective view of the flight vehicle in FIG. 2A with the lock block and wings in the deployed position, and FIG. 2E is a partial perspective underside view of the lock block and wings in the deployed position. Flight vehicle 30 includes lock block 10, wings 32 (first wing 32A and second wing 32B), pivot pins 34 (first pivot pin 34A and second pivot pin 34B), and housing 36. Wings 32 include inner ends 38 (first inner end 38A and second inner end 38B) with forward portions 40 and aft portion 42. Wings 32 also include grooves 44 (first groove 44A and second groove 44B). Housing 36 can include various other components, such as wing stops 46, a cover (not shown), and a stowed wing lock device (not shown). Lock block 10 is located on centerline C, which runs through the center of flight vehicle 30 along a flight path of flight vehicle 30.

From FIG. 2A to FIG. 2E, lock block 10 and wings 32 progress from the stowed position (FIGS. 2A and 2B) to the deployed and locked position (FIGS. 2D and 2E). Wings 32 are stowed within housing 36 before and during launch of flight vehicle 30. After launch, wings 32 are deployed and remain in the deployed position, in which wings 32 extend outward from housing 32, until the end of the flight. With wedge 22 positioned between inner ends 38 of wings 32 when wings 32 are deployed, wings 32 are locked in the deployed position and cannot unintentionally pivot out of the deployed position, which would make flight vehicle 30 difficult to control.

Looking at FIGS. 2A and 2B, lock block 10 is in the aft position and wings 32 are in the stowed position located within housing 36. With lock block 10 in the aft position, resilient member 18 (not viewable) is compressed between body 17 and a component of housing 36. In the stowed position, wings 32 are held in place within housing 36 parallel to centerline C by a stowed wing lock device (not shown) that is connected to housing 36 near tips of wings 32. Other configurations of flight vehicle 30 may not include the stowed wing lock device and wings 32 may be held in the stowed position by walls of a munitions bay or another exterior device used to launch flight vehicle 30. When wings 32 are in the stowed position, flight vehicle 30 is more streamlined and can be launched from a munitions bay without wings 32 becoming damaged or otherwise obstructing the launch. As shown in FIG. 2B, deploy pins 20 extend into grooves 44 in forward portion 40 of inner ends 38 when in the stowed position (with first deploy pin 20A within first groove 44A in first inner end 38A and second deploy pin 20B within second groove 44B in second inner end 38B). In the stowed position, wedge 22 (not viewable) is aft of wings 32 and is not in contact with inner ends 38 of wings 32

With wings 32 in the stowed position, grooves 44 are substantially perpendicular to centerline C and may angle or curve partially in an aft direction to more easily and completely allow deploy pins 20 to push inner ends 38 of wings 32 forward into the deployed position and then disengage grooves 44 to allow wedge 22 to move into place between inner ends 38 of wings 32 (as shown in FIG. 2E). Grooves 44 can extend completely through inner ends 38 of wings 32, but wings 32 of flight vehicle 30 have grooves 44 with a depth that is equal to the length deploy pins 20 extend downward from support member 16 of lock block 10. A width of grooves 44 is equal to or greater than a width of deploy pins 20 to allow deploy pins 20 to easily move within groove 44 when lock block 10 is moving from the stowed position/the aft position to the deployed position/the forward position. Grooves 44 can be machined into inner ends 38 of wings 32 or can otherwise be formed at the same time wings 32 are being constructed. While grooves 44 can have any length, width, size, or shape, grooves 44 should be configured to allow deploy pins 20 to move within groove 44 to push forward portion 40 of inner ends 38 forward, causing wings 32 to rotate about pivot pins 34 into a deployed position (first wing 32A rotates about first pivot pin 34A and second wing 32B rotates about second pivot pin 34B). First groove 44A is similar in size, shape, and configuration to second groove 44B. However, to ensure first wing 32A and second wing 32B deploy at the same rate (so that control of flight vehicle 30 is more accurate and predictable), first groove 44A can mirror second groove 44B so that first deploy pin 20A moves at a same rate through first groove 44A as second deploy pin 20B moves through second groove 44B.

Pivot pins 34 (first pivot pin 34A and first pivot pin 34B) are located at inner ends 38 of wings 32 and allow first wing 32A and second wing 32B to rotate about first pivot pin 34A and second pivot pin 34B, respectively, from the stowed position to the deployed position. Pivot pins 34 can be constructed from any material and are secured and prevented from nonrotational movement by housing 36. Pivot pins 34 can be fastened to wings 32 so as to rotate along with wings 32, or pivot pins 34 can be nonrotating such that wings 32 rotate around pivot pins 34 with pivot pins 34 remaining stationary.

Flight vehicle 30 with lock block 10 and wings 32 in the stowed position allows flight vehicle 30 to be launched from various apparatuses without fear of damaging wings 32 due to the high forces experienced by flight vehicle 30 during launch. With lock block 10 being in line with wings 32 (not extending substantially above or below wings 32) and taking up little space within flight vehicle 30, more space is available on flight vehicle 30 for payload, which is of great importance for glide bombs and precision guided munitions.

FIG. 2C shows lock block 10 and wings 32 between the stowed position and the deployed position, which would occur after the stowed wing lock device (not shown) releases wings 32 and resilient member 18 of lock block 10 is allowed to decompress/extend to push lock block 10 in the forward direction. With lock block 10 being pushed in the forward direction by resilient member 18, deploy pins 20 push on the sides of grooves 44, causing forward portion 40 of inner ends 38 of wings 32 to move forward, which in turn causes wings 32 to rotate about pivot pins 34. As shown in FIG. 2C, deploy pins 20 have moved within grooves 44 but have not yet moved the full length of grooves 44 so as to no longer be within grooves 44 (as is the case when wings 32 are in the deployed position as shown in FIG. 2E). Due to the expansive force exerted on lock block 10 by resilient member 18, the position shown in FIG. 2C (a position between the stowed position and the deployed position) only occurs for a short time until wings 32 contact wing stops 46 and wings 32 are fully deployed.

FIGS. 2D and 2E show lock block 10 and wings 32 in the deployed position, with wings 32 being positioned at an angle that is approximately eighty degrees from wings 32 in the stowed position and centerline C. Lock block 10 is in the forward position with wedge 22 wedged in place between inner ends 38 of wings 32. Additionally, deploy pins 20 are forward of and disengaged from grooves 44 in inner ends 38, with grooves 44 running substantially parallel to centerline C (or slightly angled inwards towards centerline C) due to the rotation of wings 32 about pivot pins 34. As shown in FIG. 2D, wings 32 may extend outward at an angle that is slightly forward such that wings 32 rotate less than ninety degrees when rotating from the stowed position to the deployed position. In the deployed position, lock block 10 has been pushed all the way to the forward position and cannot move forward anymore due to wedge 22 being wedged between inner ends 38 of wings 32.

Resilient member 18 continues to exert an expansive force on lock block 10 to ensure lock block 10 remains in place in the forward position and wedge 22 remains in place between inner ends 38 of wings 32. The expansive force exerted by resilient member 18 is balanced by inner ends 38 of wings 32. As seen most easily in FIG. 2E, forward portion 40 of inner ends 38 extends inward from pivot pins 34 further than aft portion 32 of inner ends 38, resulting in forward portion 40 of inner ends 38 being in contact with and pushing on wedge 22. With wedge 22 being substantially triangular in shape, the force exerted on wedge 22 by resilient member 18 causes wedge 22 to be squeezed between forward portion 40 of inner ends 28, preventing lock block 10 from moving forward and inner ends 38 of wings 32 from moving/rotating. The configuration of inner ends 38 with forward portion 40 being closer to centerline C than aft portion 42 prevents wings 32 from rotating when wedge 22 is in place because an innermost point of forward portion 40 of inner ends 38 would need to move inwards towards centerline C for wings 32 to rotate about pivot pins 34 out of the deployed position. However, the innermost point of forward portion 40 of inner ends 38 is prevented from moving inwards towards centerline C by wedge 22. Thus, wings 32 are held and locked in the deployed position by wedge 22.

FIG. 3A is a perspective view of another embodiment of a lock block, and FIG. 3B is a partial cross-sectional perspective view of a flight vehicle with the lock block and wings in the deployed position. As shown in FIG. 3A, lock block 110 includes forward end 112, aft end 114, support member 116 (with slot 116A), a resilient member (not shown), resilient member holes 118, deploy pins 120 (with first deploy pin 120A and second deploy pin 120B), wedge 122, and volume 123. As shown in FIG. 3B, flight vehicle 130 includes housing 136 and mating feature 148 with forward end 150 and aft end 152.

The functionality of lock block 110 in FIGS. 3A and 3B is the same as lock block 10 in FIGS. 1, 2A, 2B, 2C, 2D, and 2E. However, lock block 110 has a different configuration than the configuration of lock block 10. Lock block 110 is wider with support member 116 having an approximately square-shaped configuration with bulges extending from sides of support member 116 to provide holes to accommodate deploy pins 120. In FIG. 3A, the holes in support member 116 and deploy pins 120 that extend downward from support member 116 are located closer to aft end 114 of lock block 110 than to forward end 112. As with the previously discussed embodiment, deploy pins 120 engage grooves in the wings to push the wings from the stowed position to the deployed position. At a position near the deployed position, deploy pins 120 disengage from the grooves so that lock block 110 can continue in a forward direction to lock the wings in place in the deployed position.

Wedge 122 also has a different configuration than wedge 22 of lock block 10. In lock block 110, wedge 122 is located adjacent aft end 114 and includes resilient member holes 118 into which the resilient member extends. Wedge 122 is adjacent to volume 123 on a forward side. Lock block 110 does not include a component similar to body 17 of lock block 10. Outer sides of wedge 122 are substantially parallel to centerline C and contact the inner ends of the wings when in the deployed position at an area that is closer to aft end 114 than that of wedge 22 of lock block 10.

Volume 123 is on a bottom side of support member 116 and extends from wedge 122 towards forward end 112. Volume 123 can provide structural support and a mass into which resilient member holes 118 can extend into. Generally, volume 123 may not come into contact with the inner ends of the wings. While volume 223 is shown in FIG. 4 as having a substantially rectangular shape that angles inward from wedge 122 near deploy pins 120, volume 123 and wedge 122 can have other shapes, orientations, and configurations.

As shown in FIG. 3B, resilient member holes 118 can be within wedge 122 and volume 123 to accommodate a resilient member similar to that shown in FIGS. 1 and 2C. As discussed above, it may be desired to contain the resilient member within resilient member holes 118 in wedge 122 and volume 123 when space is limited around lock block 110. Resilient member holes 118 can be only one hole or more than two holes depending on design considerations. Additionally, the diameter, depth, and shape of resilient member holes 118 can be configured to accommodate any size or type of resilient member.

Support member 116 includes slot 116A on a top side that extends between forward end 112 and aft end 114. Slot 116A is a groove that interacts with mating feature 148 in housing 136. Slot 116A and mating feature 148 work in tandem to guide lock block 110 and ensure that lock block 110 remains centered along centerline C. Slot 116A of lock block 110 is substantially constant in width and height along support member 116 with a narrower width portion near forward end 112 of lock block 110. Slot 116A can have a varying width or a configuration that is different than that shown in FIGS. 3A and 3B, but slot 116A should be configured to interact with mating feature 148. As shown in FIG. 3B, mating feature 148 has a width that is greater near aft end 152 than a width of mating feature 148 that is near forward end 150 of mating feature 148.

The varying width of mating feature 148 provides a number of benefits. The greater width of mating feature 148 at aft end 152 keeps lock block 110 centered along centerline C when lock block 110 is in an aft position and the wings are in the stowed position (i.e., the greater width portion of mating feature 148 prevents side-to-side movement of lock block 110 when lock block 110 is in the aft position/stowed position). With slot 116A having the narrower width portion near forward end 112 of lock block 110, the narrower portion of slot 116A can contact the wider portion of mating feature 148 to prevent lock block 110 from moving too far in the aft direction. When lock block 110 moves from the aft position to the forward position to move the wings from the stowed position to the deployed position, lock block 110 and slot 116A move from a position in which sides of slot 116A are in contact with the wider portion of mating feature 148 to a position in which sides of slot 116A are adjacent to but not necessarily in contact with the narrower portion of mating feature 148 (as shown in FIG. 3B). In this position, lock block 110 is not prevented from side-to-side movement by mating feature 148 because a gap is present between mating feature 148 and the sides of slot 116A. This allows lock block 110 to center itself between the inner ends of the wings. Allowing lock block 110 to center itself between the inner ends of the wings ensures that lock block 110 is in contact with each of the inner ends of the wings and that contact is equalized to securely lock the wings in the deployed position.

FIG. 4 is a perspective view of a third embodiment of a lock block. Lock block 210 includes forward end 212, aft end 214, support member 216 (with slot 216A and neck 216B), a resilient member (not shown), resilient member holes (not shown), deploy pins 220 (with first deploy pin 220A and second deploy pin 220B), wedge 222, and volume 223.

The functionality of lock block 210 in FIG. 4 is the same as lock block 10 in FIGS. 1, 2A, 2B, 2C, 2D, and 2E and lock block 110 in FIGS. 3A and 3B. However, lock block 210 has a different configuration than the configuration of previously discussed embodiments. Support member 216 of lock block 210 has a wider portion near aft end 214 that extends approximately parallel to centerline C until support member 216 bulges outward from sides of support member 216 to provide holes to accommodate deploy pins 220. In FIG. 4, the holes in support member 216 and deploy pins 220 that extend downward are located approximately equidistant between forward end 212 and aft end 214, or may be slightly closer to aft end 214. As with previously discussed embodiments, deploy pins 220 engage grooves in the wings to push the wings from the stowed position to the deployed position. At a position near the deployed position, deploy pins 220 disengage from the grooves so that lock block 210 can continue in a forward direction to lock the wings in place in the deployed position.

The configuration of wedge 222 of lock block 210 is very similar to wedge 122 of lock block 110. In lock block 210, wedge 222 is located adjacent aft end 214 and includes resilient member holes (now shown) into which the resilient member extends. Wedge 222 has a width that is equal to a width of support member 216 near aft end 214. Wedge 222 is adjacent to volume 123 on a forward side. Lock block 210 does not include a component similar to body 17 of lock block 10. Outer sides of wedge 222 are substantially parallel to centerline C and contact the inner ends of the wings when in the deployed position at an area that is closer to aft end 214 than that of wedge 22 of lock block 10.

Similar to volume 123 of lock block 110, volume 223 is on a bottom side of support member 216 and extends from wedge 222 towards forward end 212. Volume 223 can provide structural support and a mass into which the resilient member holes can extend into. Generally, volume 223 may not come into contact with the inner ends of the wings. While volume 223 is shown in FIG. 4 as having a substantially rectangular shape, volume 223 and wedge 222 can have other shapes, orientations, and configurations.

Support member 216 includes neck 216B, which is a narrow portion that extends outward from support member 216 in the forward direction to forward end 212. Neck 216B can have a constant or varying height or width depending on design considerations and the configuration of a housing of a flight vehicle in which lock block 210 is located.

Slot 216A is on a top side of support member 216 and extends within neck 216B and support member 216 between forward end 112 and aft end 114. Slot 216A is similar in configuration and functionality to slot 116A of lock block 110, except that slot 216A has a width that is greater near aft end 114 than a width of slot 216A near forward end 112. Slot 216A is substantially constant in height along lock block 210. Slot 216A can have a varying width or a configuration that is different than that shown in FIG. 4, but slot 216A should be configured to interact with a mating feature in the housing of the flight vehicle (similar to mating feature 148 in FIG. 3B). The mating feature that interacts with slot 216A of lock block 210 can be an extension that extends a length that is longer than a length of lock block 210, or the mating feature can be one or a number of downwardly extending pins/cylinders. When lock block 210 is at or near the aft position, the mating feature is within a narrow portion of slot 216A near forward end 112 to prevent lock block 210 from side-to-side movement and ensure lock block 210 is centered along centerline C. When lock block 210 moves from the aft position to the forward position to move the wings from the stowed position to the deployed position, lock block 210 and slot 216A move from a position in which sides of the narrower portion of slot 216A are in contact with the mating feature to a position in which sides of a wider portion of slot 216A are adjacent to but not necessarily in contact with the mating feature. In this position, lock block 210 is not prevented from side-to-side movement by the mating feature because a gap is present between the mating feature and sides of the wider portion of slots 216A that allows lock block 210 to center itself between the inner ends of the wings.

A wing deployment and lock mechanism on flight vehicle 30 is described herein that includes lock block 10/110/210 with deploy pins 20/120/220 that move within grooves 44 on inner ends 38 of two deployable wings 32. When lock block 10/110/210 moves from the aft position to the forward position caused by the expansive force of resilient member 18, deploy pins 20/120/220 move within grooves 44 to pivot wings 32 from the stowed position to the deployed position. When wings 32 reach the deployed position, deploy pins 20/120/220 are pushed forward to disengage grooves 44 such that deploy pins 20/120/220 are forward of grooves 44 and wedge 22/122/222 on lock block 10/110/210 becomes positioned between inner ends 38 of wings 32. With wedge 22/122/222 in place between inner ends 38 of wings 32, wings 32 are prevented from pivoting out of the deployed position and are locked in place due to the shape of inner ends 38 of wings 32 and the shape of wedge 22/122/222.

The use of lock block 10/110/210 to deploy and lock wings 32 in place has many benefits. The mechanism (lock block 10/110/210 and grooves 44 in wings 32) is simple and includes very few components, with lock block 10/110/210 having deploy pins 20/120/220, wedge 22/122/222, and resilient member 18 configured to move lock block 10/110/210 from the aft position to the forward position, and wings 32 having grooves 44 and angled inner ends 38 that pivot about pivot pins 34. The mechanism is rugged and able to handle the extreme forces sustained by flight vehicle 30 during launch and flight because the components are close-fitted but also have sufficient room to move and vibrate without becoming separated from one another. Because lock block 10/110/210 and the other components are simple and rugged, the wing deployment and lock mechanism is more reliable by being less prone to damage and malfunction. The system is also inexpensive, as the materials used to construct lock block 10/110/210, resilient member 18, and wings 32 can be common, inexpensive materials. Further, the shape of lock block 10/110/210 and wings 32 is simple such that molding and/or machining of these components is not burdensome. With lock block 10/110/210 interacting with both wings 32 simultaneously, wings 32 are deployed at the same time, allowing more accurate control of flight vehicle 30 during and after deployment of wings 32. The wing deployment and locking mechanism holds wings 32 securely in the deployed and locked position, and provides accurate and tight control of the angle of incidence of wings 32 so that wings 32 are properly placed in the deployed position and control of flight vehicle 30 is correct and predictable. The wing deployment and locking mechanism is compact, particularly minimizing encroachment of components towards the center of flight vehicle 30, where the volume is used for carrying payload.

Discussion of Possible Embodiments

The following are non-exclusive descriptions of possible embodiments of the present invention.

A wing deployment and lock mechanism includes a first wing that is configured to pivot about a first pivot pin at an inner end of the first wing with the first wing having a first groove in the inner end of the first wing, a second wing that is configured to pivot about a second pivot pin at an inner end of the second wing with the second wing having a second groove in the inner end of the second wing, and a lock block that is adjacent to the inner end of the first wing and the inner end of the second wing. The lock block having a forward end and an aft end and includes a resilient member adjacent the aft end, a first deploy pin configured to be positioned within the first groove in the first wing when the first wing is in a stowed position and be positioned forward of the first groove of the first wing when the first wing is in a deployed position, a second deploy pin configured to be positioned within the second groove in the second wing when the second wing is in a stowed position and be positioned forward of the second groove of the second wing when the second wing is in the deployed position, and a wedge between the forward end and the aft end with the wedge configured to be aft of the first wing and the second wing when in the stowed position and to contact and lock the inner end of the first wing and the inner end of the second wing in place when in the deployed position.

The wing deployment and lock mechanism of the preceding paragraph can optionally include, additionally and/or alternatively, any one or more of the following features, steps, configurations, and/or additional components:

A housing adjacent to the lock block with the housing including a mating feature that extends downward and a slot in the lock block extending from the forward end to the aft end of the lock block with the slot being adjacent to the mating feature and configured to allowed the mating feature to slide therein.

The slot is wider at the aft end of the lock block than at the forward end of the lock block.

The mating feature is wider at an aft end of the mating feature than at a forward end of the mating feature.

The wedge has a width that is greater near the aft end than a width of the wedge near the forward end of the lock block.

A forward portion of the inner end of the first wing forms a locking surface that extends further inward from the first pivot pin when in the deployed position than an aft portion of the inner end of the first wing so that the first wing is locked in place by the wedge contacting the locking surface on the inner end of the first wing and cannot pivot about the first pivot pin when in the deployed position.

A forward portion of the inner end of the second wing forms a locking surface that extends further inward from the second pivot pin when in the deployed position than an aft portion of the inner end of the second wing so that the second wing is locked in place by the wedge contacting the locking surface on the inner end of the second wing and cannot pivot about the second pivot pin when in the deployed position.

The lock block is located on a centerline that extends an equal distance between the first pivot pin and the second pivot pin.

The first deploy pin and the second deploy pin extend from a bottom side of the lock block.

The wedge is located on a bottom side of the lock block.

The first groove in the first wing and the second groove in the second wing are similarly shaped but mirrors of one another so that the first deploy pin moves through the first groove and the second deploy pin moves through the second groove an equal distance from the stowed position to the deployed position to make the first wing and the second wing deploy at a same rate.

The first wing and the second wing in the deployed position are each positioned approximately eighty degrees from the first wing and the second wing in the stowed position, respectively.

A method for deploying two wings includes pushing a lock block in a forward direction through the use of a resilient member at an aft end of the lock block with the lock block including two deploy pins and a wedge positioned between the forward end and the aft end, moving the lock block from a stowed position where each of the two deploy pins are within grooves in the two wings to a deployed position where each of the two deploy pins are forward of the two wings, are no longer within the grooves, and have forced the two wings to have pivoted through a deploy angle, and positioning the wedge between inner ends of the two wings so that the two wings are locked in place and cannot pivot out of the deployed position.

The method of the preceding paragraph can optionally include, additionally and/or alternatively, any one or more of the following features, steps, configurations, and/or additional components:

The step of releasing a stowed wing lock device to allow the resilient member to push the lock block forward.

The two deploy pins move within the grooves to encourage the two wings to pivot from the stowed position to the deployed position.

The wedge is located on a bottom side of the lock block.

The two deploy pins extend from a bottom side of the lock block to engage the grooves.

A lock block having an aft end and a forward end includes a support member, a resilient member at the aft end of the support member, a first deploy pin extending from the support member, a second deploy pin extending from the support member, and a wedge located on a bottom side of the support member.

The lock block of the preceding paragraph can optionally include, additionally and/or alternatively, any one or more of the following features, steps, configurations, and/or additional components:

The first deploy pin and the second deploy pin extend from the bottom side of the support member adjacent the forward end.

A body at the aft end of the lock block between the support member and the resilient member, the body having at least one resilient member hole into which the resilient member extends.

The wedge is wider near the aft end than the wedge near the forward end of the body.

Any relative terms or terms of degree used herein, such as "substantially," "essentially," "generally," "approximately," and the like should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations; incidental alignment variations; alignment or shape variations induced by thermal, rotational, or vibrational operational conditions; and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A wing deployment and lock mechanism comprising:

a first wing configured to pivot about a first pivot pin at an inner end of the first wing with the first wing having a first groove in the inner end of the first wing;

a second wing configured to pivot about a second pivot pin at an inner end of the second wing with the second wing having a second groove in the inner end of the second wing;

a lock block adjacent to the inner end of the first wing and the inner end of the second wing, the lock block having a forward end an aft end, and a bottom side with the lock block comprising:

a resilient member adjacent the aft end;

a first deploy pin extending from the bottom side of the lock block and configured to be positioned within the first groove in the first wing when the first wing is in a stowed position and be positioned forward of the first groove of the first wing when the first wing is in a deployed position;

a second deploy pin extending from the bottom side of the lock block and configured to be positioned within the second groove in the second wing when the second wing is in a stowed position and be positioned forward of the second groove of the second wing when the second wing is in a deployed position; and a wedge between the forward end and the aft end, the wedge configured to be aft of the first wing and the second wing when in the stowed position and to contact and lock the inner end of the first wing and the inner end of the second wing in place when in the deployed position.

2. The wing deployment and lock mechanism of claim 1, further comprising:

a housing adjacent to the lock block, the housing including a mating feature that extends downward; and a slot in the lock block extending from the forward end to the aft end of the lock block, the slot being adjacent to the mating feature and configured to allowed the mating feature to slide therein.

3. The wing deployment and lock mechanism of claim 2, wherein the slot is wider at the aft end of the lock block than at the forward end of the lock block.

4. The wing deployment and lock mechanism of claim 2, wherein the mating feature is wider at an aft end of the mating feature than at a forward end of the mating feature.

5. The wing deployment and lock mechanism of claim 1, wherein the wedge has a width that is greater near the aft end than a width of the wedge near the forward end of the lock block.

6. The wing deployment and lock mechanism of claim 5, wherein a forward portion of the inner end of the first wing forms a locking surface that extends further inward from the first pivot pin when in the deployed position than an aft portion of the inner end of the first wing so that the first wing is locked in place by the wedge contacting the locking surface on the inner end of the first wing and cannot pivot about the first pivot pin when in the deployed position, and wherein a forward portion of the inner end of the second wing forms a locking surface that extends further inward from the second pivot pin when in the deployed position than an aft portion of the inner end of the second wing so that the second wing is locked in place by the wedge contacting the locking surface on the inner end of the second wing and cannot pivot about the second pivot pin when in the deployed position.

7. The wing deployment and lock mechanism of claim 1, wherein the lock block is located on a centerline that extends an equal distance between the first pivot pin and the second pivot pin.

8. The wing deployment and lock mechanism of claim 1, wherein the wedge is located on a bottom side of the lock block.

9. The wing deployment and lock mechanism of claim 1, wherein the first groove in the first wing and the second groove in the second wing have the same shape but are mirrors of one another so that the first deploy pin moves through the first groove and the second deploy pin moves through the second groove an equal distance from the stowed position to the deployed position to make the first wing and the second wing deploy at a same rate.

10. The wing deployment and lock mechanism of claim 1, wherein the first wing and the second wing in the deployed position are each positioned approximately eighty degrees from the first wing and the second wing in the stowed position, respectively.

11. A method for deploying two wings, the method comprising:

pushing a lock block in a forward direction through the use of a resilient member at an aft end of the lock block, the lock block includes two deploy pins and a wedge, the wedge positioned between the forward end and the aft end on a bottom side of the lock block;

moving the lock block from a stowed position where each of the two deploy pins are within grooves in the two wings to a deployed position where each of the two deploy pins are forward of the two wings, are no longer within the grooves, and have forced the two wings to have pivoted through a deploy angle; and positioning the wedge between inner ends of the two wings so that the two wings are locked in place and cannot pivot out of the deployed position.

12. The method of claim 11, further comprising:

releasing a stowed wing lock device to allow the resilient member to push the lock block forward.

13. The method of claim 11, wherein the two deploy pins move within the grooves to encourage the two wings to pivot from the stowed position to the deployed position.

14. The method of claim 11, wherein the two deploy pins extend from a bottom side of the lock block to engage the grooves.

15. A wing deployment and lock mechanism comprising:

a first wing configured to pivot about a first pivot pin at an inner end of the first wing with the first wing having a first groove in the inner end of the first wing;

a second wing configured to pivot about a second pivot pin at an inner end of the second wing with the second wing having a second groove in the inner end of the second wing;

a lock block adjacent to the inner end of the first wing and the inner end of the second wing, the lock block having a forward end and an aft end, the lock block comprising:

a resilient member adjacent the aft end;

a first deploy pin configured to be positioned within the first groove in the first wing when the first wing is in a stowed position and be positioned forward of the first groove of the first wing when the first wing is in a deployed position;

a second deploy pin configured to be positioned within the second groove in the second wing when the second wing is in a stowed position and be positioned forward of the second groove of the second wing when the second wing is in a deployed position; and a wedge between the forward end and the aft end on a bottom side of the lock block, the wedge configured to be aft of the first wing and the second wing when in the stowed position and to contact and lock the inner end of the first wing and the inner end of the second wing in place when in the deployed position.

16. The wing deployment and lock mechanism of claim 15, further comprising:

a housing adjacent to the lock block, the housing including a mating feature that extends downward; and a slot in the lock block extending from the forward end to the aft end of the lock block, the slot being adjacent to the mating feature and configured to allowed the mating feature to slide therein.

17. The wing deployment and lock mechanism of claim 16, wherein the slot is wider at the aft end of the lock block than at the forward end of the lock block.

18. The wing deployment and lock mechanism of claim 16, wherein the mating feature is wider at an aft end of the mating feature than at a forward end of the mating feature.

19. The wing deployment and lock mechanism of claim 15, wherein the wedge has a width that is greater near the aft end than a width of the wedge near the forward end of the lock block.

20. The wing deployment and lock mechanism of claim 15, wherein the lock block is located on a centerline that extends an equal distance between the first pivot pin and the second pivot pin.

* * * * *